US005537922A

United States Patent [19]

Becker

[11] Patent Number: 5,537,922

[45] Date of Patent: Jul. 23, 1996

[54] PRESS-ON DEVICE IN A PRINTING UNIT OF A PRINTING PRESS

[75] Inventor: Willi Becker, Bammental, Germany

[73] Assignee: Heidelberger Druckmaschinen AG, Heidelberg, Germany

[21] Appl. No.: 441,725

[22] Filed: May 15, 1995

[30] Foreign Application Priority Data

May 14, 1994 [DE] Germany ..... 44 17 054.8

[51] Int. Cl.[6] ..... B41F 5/00

[52] U.S. Cl. ..... 101/216; 101/230; 100/53; 74/612

[58] Field of Search ..... 101/142, 216, 101/212, 219, 230; 271/195; 100/53; 74/612, 613, 614, 615

[56] References Cited

U.S. PATENT DOCUMENTS

| | | | |
|---|---|---|---|
| 3,498,217 | 3/1970 | Kletti . | |
| 3,976,007 | 8/1976 | Junghans et al. | 101/142 |
| 4,295,421 | 10/1981 | Abendroth et al. . | |
| 4,454,812 | 6/1984 | Johne et al. . | |
| 4,669,380 | 6/1987 | Seib et al. | 101/216 |
| 4,765,240 | 8/1988 | Kraus et al. | 101/216 |
| 4,854,233 | 8/1989 | Despot et al. | 100/53 |
| 4,869,166 | 9/1989 | Mathes . | |
| 4,870,900 | 10/1989 | Robertson | 101/216 |
| 4,905,596 | 3/1990 | Kobler | 101/216 |
| 5,024,155 | 6/1991 | Jahn | 101/216 |
| 5,241,903 | 9/1993 | Lampic | 101/216 |
| 5,309,832 | 5/1994 | Merkel et al. . | |
| 5,373,787 | 12/1994 | Junghans et al. | 101/212 |
| 5,398,925 | 3/1995 | Zeltner | 271/195 |

FOREIGN PATENT DOCUMENTS

| | | |
|---|---|---|
| 0306684 | 3/1989 | European Pat. Off. . |
| 1561070 | 3/1970 | Germany . |
| 4218602 | 11/1993 | Germany . |
| 4231906 | 3/1994 | Germany . |

*Primary Examiner*—Eugene H. Eickholt
*Attorney, Agent, or Firm*—Herbert L. Lerner; Laurence A. Greenberg

[57] ABSTRACT

In a printing unit of a printing press having a plate cylinder and a blanket cylinder, there is provided a combination including a press-on device having a press-on roller applicable against the plate cylinder and swivelable at a spaced distance therefrom about a swivel axis aligned parallel to respective axes of the cylinders, a finger-protection device and a blast air device for blowing air against one of the cylinders, the press-on bar having a longitudinal axis and having a plurality of rollers rotatably mounted thereon, and the blast-air device being formed of a hollow interior of the press-on bar for receiving blast air therein, and nozzle openings in the surface of the press-on bar for discharging blast air from the hollow interior thereof, the longitudinal axis of the press-on bar together with the plurality of rollers rotatably mounted on the press-on bar and the swivel axis being swivelable substantially on a plane passing through a nip between the plate cylinder and the blanket cylinder about the swivel axis in a direction opposite to a direction wherein the press-on roller is applied against the plate cylinder and against a spring-biasing force and being cooperatively engageable with a switching element connected in a circuit of a drive for the printing press.

14 Claims, 4 Drawing Sheets

PRESS-ON DEVICE IN A PRINTING UNIT OF A PRINTING PRESS

BACKGROUND OF THE INVENTION

1. Field of the Invention

The invention relates to a press-on device in a printing unit of a printing press, more particularly, having a plate cylinder and a rubber blanket cylinder, including a press-on roller applicable against the plate and being swivelable at a spaced distance therefrom about a swivel axis aligned parallel to the axes of the cylinders.

Such a press-on device has been disclosed in the published German Patent Document DE 42 18 602 A1. The press-on roller described therein is formed of two concentrically telescoped tubes, an inner tube of which serves as a bearing support for an outer tube freely rotatably supported thereon, and is provided at ends thereof with axially sprung journal pins, which engage in lateral guides, so that the conventional press-on roller can be displaced against a rear or trailing printing-plate end by actuating elements, fixedly connected to the printing-press frame, outside of a nip plane between the plate cylinder and the rubber-blanket cylinder, in order to insert the rear or trailing printing-plate end with a bent edge into a clamping slot of a clamping device in the plate cylinder. After the printing plate has been locked-up on the plate cylinder, the press-on roller is moved back on a reverse path into a remote rest position. Further known from this publication is a press-on roller with rings formed of elastic material and held axially spaced from one another, on the circumference of the press-on roller in circumferential grooves, the rings being rotatable due to frictional contact with the outer tube of the press-on roller.

A press-on device of similar kinematic construction and action is described in the Japanese Published Non-Prosecuted Patent Application Sho 63-191636. In this heretofore known device, the press-on roller is movable with respect to its support in a guide about a swivel axis disposed parallel to the cylinder axis, in order to promote swiveling of the printing plate onto the plate cylinder. Provided for this purpose is a pneumatic cylinder, which presses the press-on roller against the plate cylinder when the printing plate is inserted. This device also is withdrawn into a remote rest position after the printing plate has been locked up.

Furthermore, protective devices at dangerous locations of a printing unit of a printing press, particularly finger-protection devices of head-protection devices in front of the nip between the plate cylinder and the rubber blanket cylinder and in front of the printing nip between the rubber-blanket cylinder and the impression cylinder have also become known heretofore.

SUMMARY OF THE INVENTION

It is accordingly an object of the invention to provide a press-on device in a printing unit of a printing press having a reduced number of components by assigning a number of functions to the press-on device, particularly that of a protective device for finger and hand protection and furthermore, also that of a drying device for the cylinder surface, particularly of the rubber-blanket cylinder.

With the foregoing and other objects in view, there is provided, in accordance with the invention, in a printing unit of a printing press having a plate cylinder and a blanket cylinder, the combination comprising a press-on device including a press-on roller applicable against the plate cylinder and swivelable at a spaced distance therefrom about a swivel axes aligned parallel to respective axes of the cylinders, a finger-protection device and a blast air device for blowing air against one of the cylinders, the press-on bar having a longitudinal axis and having a plurality of rollers rotatably mounted thereon, and the blast-air device being formed of a hollow interior of the press-on bar for receiving blast air therein and nozzle openings in the surface of the press-on bar for discharging blast air from the hollow interior thereof, the longitudinal axis of the press-on bar together with the plurality of rollers rotatably mounted on the press-on bar and the swivel axis being swivelable substantially on a plane passing through a nip between the plate cylinder and the blanket cylinder about the swivel axis in a direction opposite to a direction wherein the press-on roller is applied against the plate cylinder and against a spring-biasing force and being cooperatively engageable with a switching element connected in a circuit of a drive for the printing press.

In accordance with another object of the invention, the press-on bar extends from one side of the printing press to the other side thereof and is connected only on the one printing-press side to a motorized controlling and swiveling mechanism and on the other printing-press side to an air-supply system, the longitudinal axis of the press-on bar being disposed at an inclination to the axis of the respective cylinder so that the longitudinal axis of the press-on bar is disposed at a greater distance from the cylinder at the printing-press side at which the controlling and swiveling mechanism is located than at the printing-press side at which the air-supply system is connected.

In accordance with a further feature of the invention, the plurality of rotatable rollers are freely rotatably mounted on the press-on roller axially spaced from one another, and the nozzle opening being directed against the blanket cylinder and being connected via the hollow interior of the press-on roller to the air-supply system.

In accordance with an added feature of the invention, the controlling and swiveling mechanism comprises a swivel lever fixedly connected to the press-on bar at the one printing press side, and a pneumatic cylinder fixed to a frame of the printing press, the pneumatic cylinder having a piston rod articulatingly connected, through the intermediary of a preloaded spring, to the swivel lever.

In accordance with an additional feature of the invention, there is provided a joint pin mounted on the swivel lever and formed with a through-bore, the piston rod extending through the through-bore of the joint pin and through a preloaded helical spring braced between the joint pin and a stop on the piston rod.

In accordance with still another feature of the invention, the press-on bar is formed of a rigid tube provided with the nozzle openings in the peripheral surface thereof, the plurality of rotatable rollers being freely rotatably mounted on the tube and annually surrounding the tube, the tube, at the ends thereof being axially offset from respective journal pins swivelably mounted on an identical axis in the frame of the printing press, one of the journal pins being connected to the swivel lever with which the piston rod of the pneumatic cylinder is in engagement.

In aceordance with still a further feature of the invention, the other of the journal pins is hollow and is connected to the hollow press-on bar so as to supply air thereto.

In accordance with still an added feature of the invention, the switching element is a limit switch, and including a control cam formed on the swivel lever, the control cam being engageable with the limit switch.

In accordance with still an additional feature of the invention, the plurality of rollers are rings of plastic material having a soft-elastic periphery.

In accordance with yet another feature of the invention, the rings are formed of plastic material and have circumferential grooves formed therein, and rings formed of soft-elastic material are received in the circumferential grooves.

In accordance with yet a further feature of the invention, there are provided linkages connecting components of the press-on bar to swivelable finger-protecting devices at other locations of the printing unit.

In accordance with yet an added feature of the invention, one of the other locations of the printing unit is in front of a nip between the blanket cylinder and an impression cylinder of the printing unit.

In accordance with yet an additional feature of the invention, the other locations of the printing unit include in front of a nip between the plate cylinder and an inking roller and in front of the printing nip of the printing unit.

In accordance with a concomitant feature of the invention, the finger-protecting devices are movable about a swivel axis parallel to the swivel axis of the press-on bar.

The press-on bar of the aforedescribed press-on device according to the invention is effective, on the one hand, as a guide element for the printing plate when the latter is inserted into the nip between the plate cylinder and the rubber-blanket cylinder as well as during the subsequent insertion of the trailing bent-away edge of the printing plate into the clamping slot of the clamping or lock-up device in the plate cylinder and may, on the other hand, remain in this operating position and serve as a finger guard or hand guard, the combination thereof with the control or switching element connected in the circuit of the printing-press drive, serving to switch off the printing-press drive if the position of the press-on bar is altered due to contact with a finger or hand.

A particularly advantageous feature of the invention is that wherein only a one-sided connection of the press-on bar is made with the motor-driven swiveling mechanism, in accordance with the invention.

In order to permit the motorized press-on movement of the press-on bar which is directed against the circumference of the plate cylinder, the press-on bar is fixedly connected to a swivel lever, a piston rod of a pneumatic cylinder which is fixed on the printing-press frame being articulatedly connected to the swivel lever, through the intermediary of a spring acting against the press-on device. Preferably, the piston rod extends through a bore formed in a joint pin disposed on the swivel lever, as well as through a preloaded helical spring braced between the joint pin and a stop provided on the piston rod. In contrast to conventional double-sided arrangements, this arrangement according to the invention is provided on one side only.

If the press-on device is used simultaneously as a drying device, particularly for a rubber-blanket cylinder, at the end of a washing operation, the press-on bar is formed of a rigid tube with nozzle openings in the wall thereof, the plurality of rollers being freely rotatably held on the tube and annularly surrounding the tube, which is connected at the ends thereof in an axially offset manner to journal pins swivelably mounted on the same axis in the printing-press frame, only one of the journal pins on one printing-press side being connected to the swivel lever which is movably engaged by the piston rod of the pneumatic cylinder. Air is supplied to the rigid tube of the press-on bar preferably through a hollow journal pin on the other printing-press side. This arrangement provides for supplying drying air which is blown against the cylinder surface through the nozzle openings formed in the wall of the tube.

Several of the foregoing features, such as the control cam and the plastic rings having a soft-elastic periphery, for example, may also be used independently, without the use of other features of the invention.

Other features which are considered as characteristic for the invention are set forth in the appended claims.

Although the invention is illustrated and described herein as embodied in A press-on device in a printing unit of a printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

DESCRIPTION OF THE PREFERRED EMBODIMENTS

Figure 2:
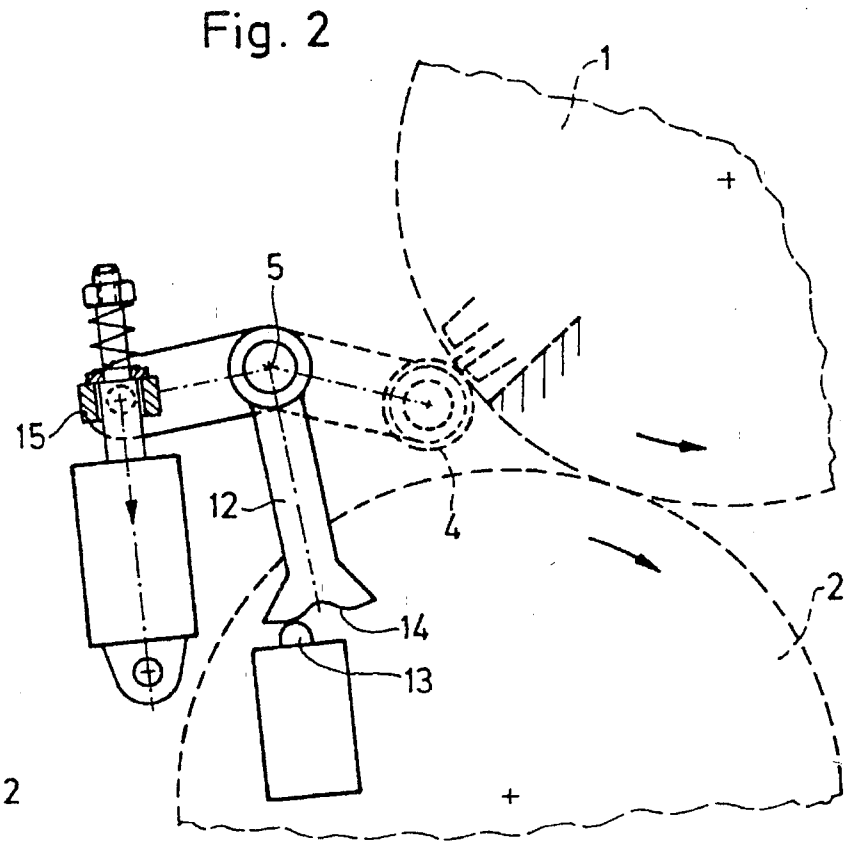
FIG. 2 is s another view of FIG. 1 showing the press-on device in a press-on position.
Figure 1:
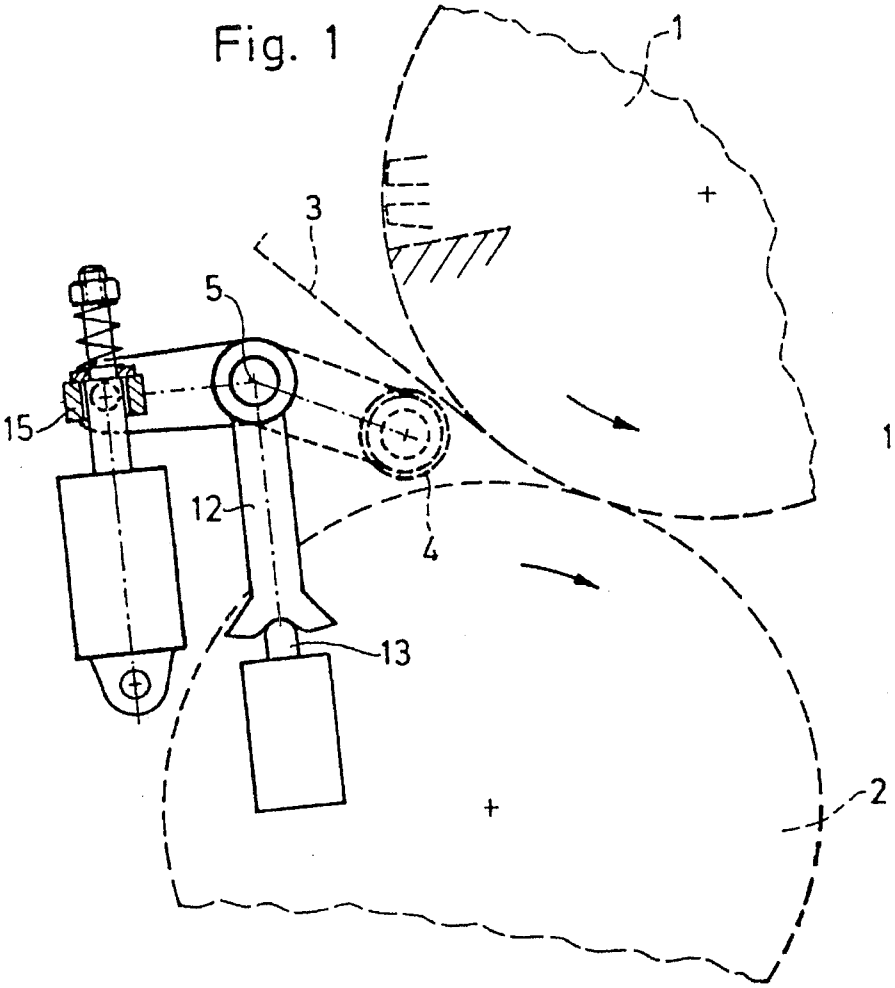
FIG. 1 is a diagrammatic side elevational view of a press-on device according to the invention serving also as a safety device and disposed in a rest position in front of a nip between a plate cylinder and a rubber-blanket cylinder of a printing unit.
Figure 4:
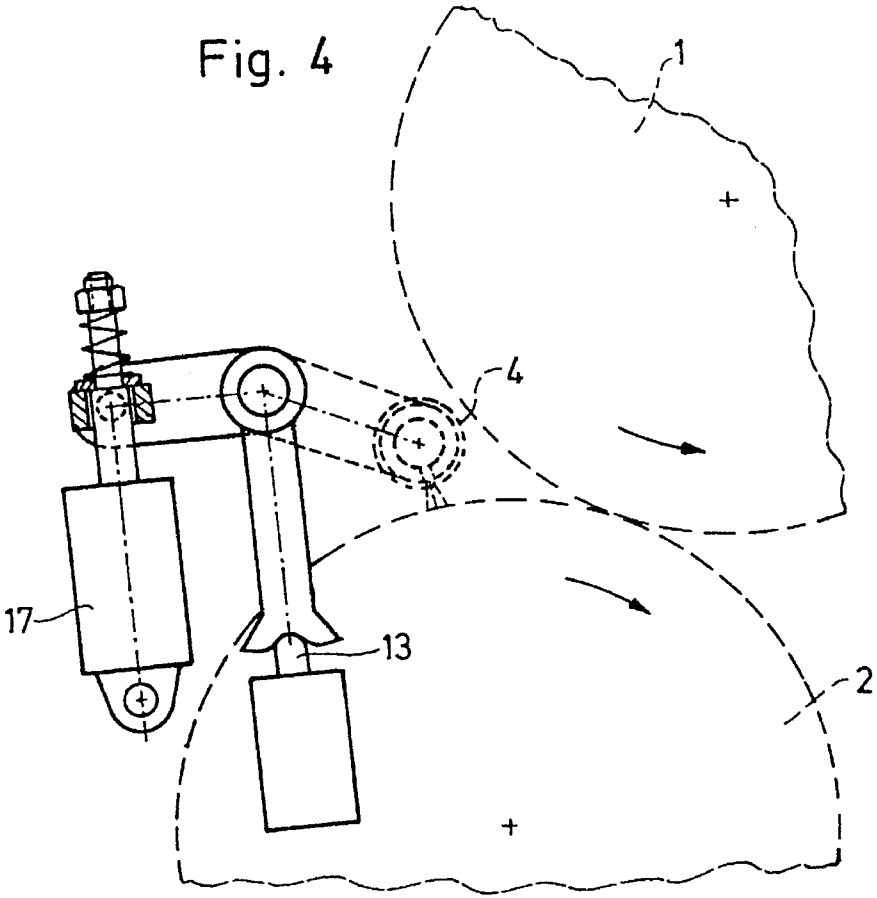
FIG. 4 is yet another view of FIG. 1 showing the press-on device operating as a drying device.
Figure 3:
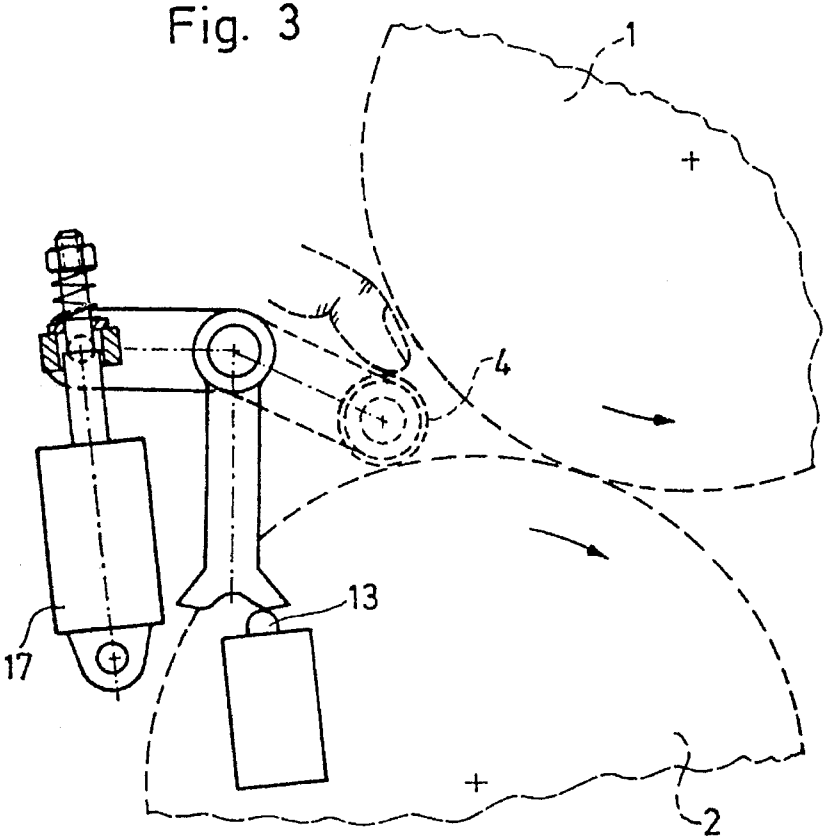
FIG. 3 is a further view of FIG. 1 showing the press-on device another operating phase thereof, wherein it functions as a finger protection device.
Figure 5:
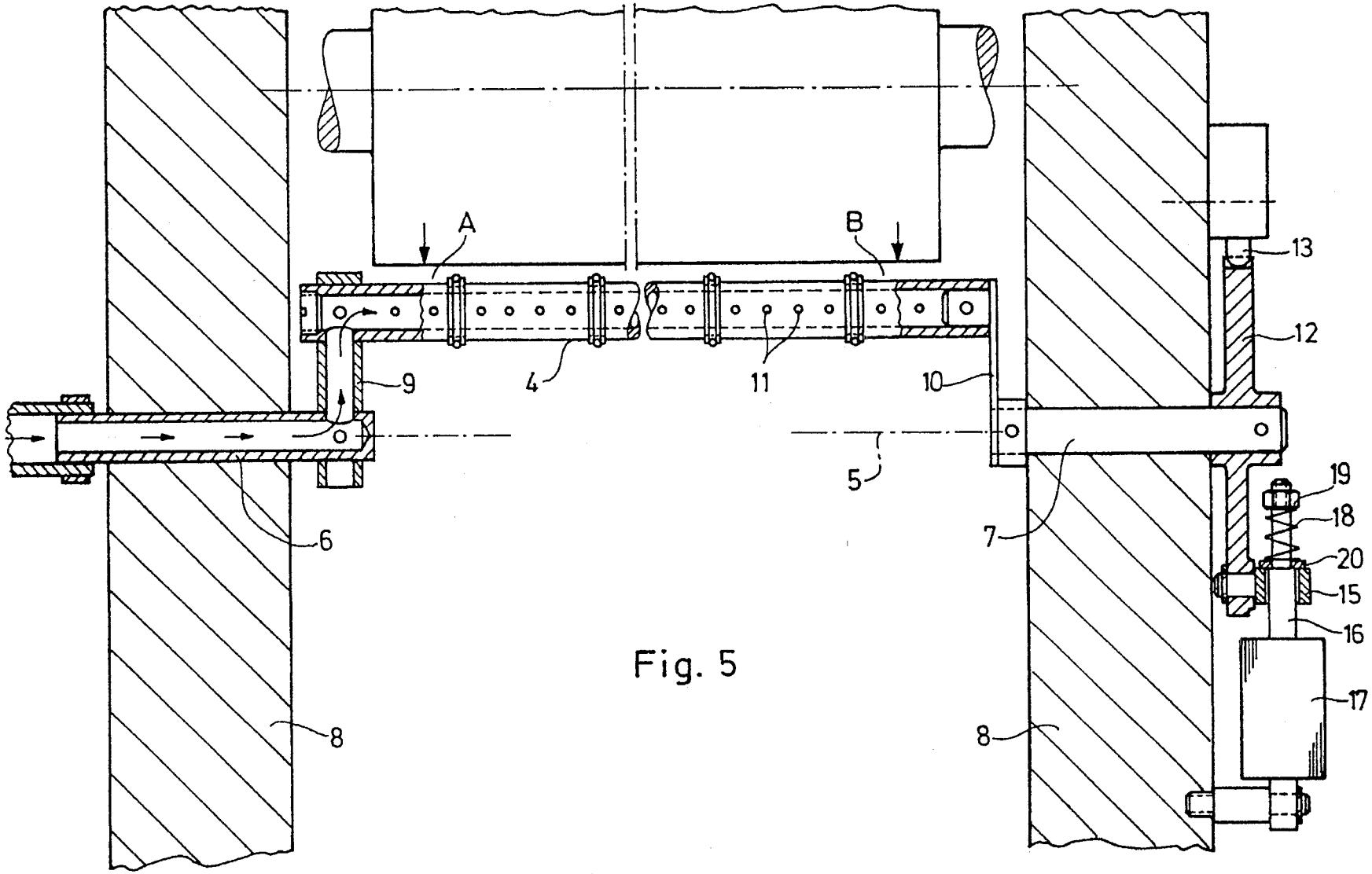
FIG. 5 is a fragmentary horizontal sectional view of FIG. 1 taken through the press-on device and the printing-press frame.
Figure 6:
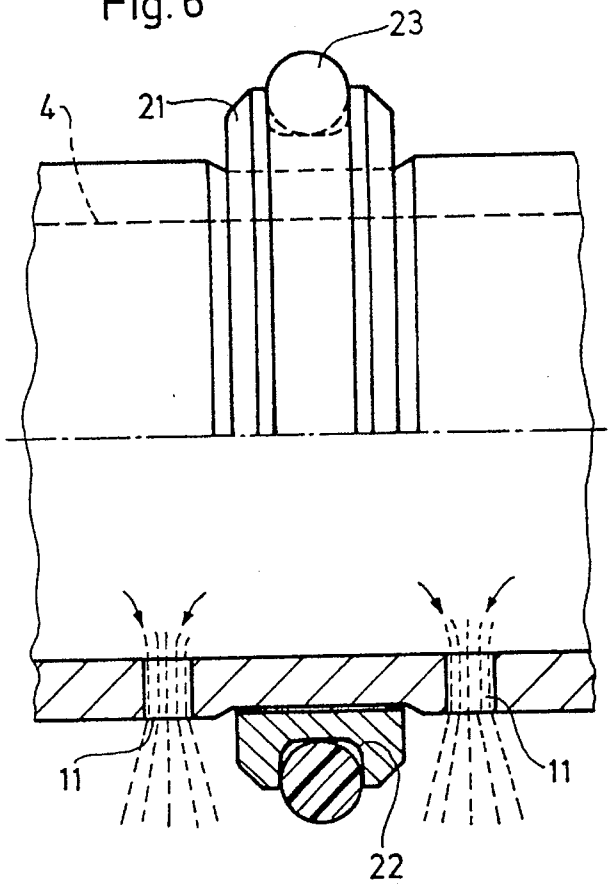
FIG. 6 is a fragmentary enlarged view of FIG. 5 showing part of a press-on bar thereof.

Referring now to the drawing and, first, particularly to FIG. 1 thereof, there is shown therein a press-on and safety device according to the invention, in front of a nip between the plate cylinder 1 and a rubber-blanket cylinder 2 of a printing unit of a printing press. The device according to the invention includes a press-on bar 4 movable against the plate cylinder 1 and therefore also against a rear or trailing end of a printing plate 3 to be clamped onto the plate cylinder 1. To this end, the press-on bar 4 is swivelable, at a distance from a swivel axis 5, about the swivel axis 5 which is aligned somewhat parallel to the axis of the cylinders 1 and 2. For this purpose, the ends of the press-on bar 4 are respectively attached, axially offset, to a respective journal pin 6 and 7 (FIG. 5), which are aligned coaxially with one another coincidentally with the swivel axis 5. Both of the journal pins 6 and 7 are each swivelably held laterally in respective side frames 8 of the printing press. The press-on bar 4 is formed of a rigid tube, each end of which is fixedly connected by a respective lever 9, 10 to one of the two journal pins 6 and 7. The one lever 9 is in the form of a hollow lever and is disposed on a hollow journal pin 6 having an outer end which is connected to an air supply of the printing press. Through the intermediary of the hollow journal pin 6 and the hollow lever 9, blast air can be directed, on one printing-press side, into the rigid tube of the press-on bar 4, so that the blast air escapes through the nozzle openings 11, direction radially against the rubber-blanket cylinder 2, when the press-on bar is used as a drying device. The other journal pin 7 on the opposite printing-press side is formed of a bolt. A double lever or bellcrank 12 is fixed on the outer end of the journal pin 7 so as to be non-rotatable relative thereto, one end of the double lever 12 being formed with a control cam 14 which cooperates with an electrical switching element 13. Disposed at the other end of the double lever or bellcrank 12 is a joint pin 15 through which a piston rod 16 of a pneumatic cylinder 17 extends, the pneumatic cylinder 17 being anchored on the printing-press frame 8. The piston rod 16 guided by the joint pin 15 further extends through a helical spring 18 so that the spring 18 is braced at one end against the joint pin 15 and at the other end against a stop collar 19 and is preloaded between those bracing members. Further situated between the helical spring 18 and the joint pin 15 is a disc 20, which engages a step formed in the piston rod 16. As provided in the illustrated embodiment, the stop collar 19 is formed as a nut, which can be screwed onto a thread formed on the piston rod 16 and permits adjustment of spring tension. The spring tension corresponds on the one hand, to the desired press-on force when a printing plate is being locked-up on a plate cylinder and, on the other hand, to a yet justifiable finger-pressing force when the press-on device is performing its finger-protection function and, finally, keeps the press-on bar in a central position between the plate cylinder and the rubber blanket cylinder, which also corresponds to the rest position of the press-on device. This motorized control or triggering and swiveling mechanism is provided on one side only. In order to compensate for any deformations of the tube forming the press-on bar 4 during the press-on motion, a special embodiment of the press-on device according to the invention provides that the tube 4 is not parallel to the cylinder surface, but extends slightly obliquely or at inclination with respect thereto. On the side of the hollow journal pin 6, a distance A between the tube forming the press-on bar 4 and the cylinder 1 is slightly smaller than a distance B between the tube and the cylinder 1 on the side of the solidly formed journal pin 7.

Plastic rings 21 formed of a material of limited elasticity are freely and easily rotatably disposed in flat recesses or grooves axially spaced from one another on the peripheral surface of the tube forming the press-on bar 4. Disposed in a circumferential recess or groove 22 of the plastic rings 21 are softly-elastic rubber rings 23, which are rotatable, by frictional contact, together with the plastic rings 21. To effect their assembly, the plastic rings 21 are stretched slightly, so that they pass over the outside diameter of the tube 4 and snap springily into the grooves or recesses which are provided. Assembly of the rubber rings 23 in the circumferential recesses or grooves 22 of the plastic rings 21 is effected in the same manner.

FIG. 1 shows the press-on device in a normal position thereof. The press-on bar 4, formed by the rigid tube, with the plastic and rubber rings 23 freely and easily rotatably mounted thereon is positioned centrally in front of the nip between plate cylinder 1 and the rubber-blanket cylinder 2. In this position, the dead weight of the press-on device acts against the preloaded compression spring. In this setting, for example, blast air is blown against the rubber blanket in order to dry it after the rubber blanket has been washed.

When the press-on device according to the invention is functioning as a finger-protection guard, contact being made by fingers or a hand in the nip between the press-on bar 4 and the plate cylinder 1, the system is swivelled against the action of the impression spring 18, the electrical switching element 13 being actuated by the triggering or control cam 14 at the one end of the double lever or bellcrank 12. If finger or hand contact occurs between the tube 4 and the rubber-blanket cylinder 2, the system swivels in the opposite direction. The joint pin 15 loosely slides, with the bore thereof, along the stationary piston rod of the pneumatic cylinder 17, so that the electrical switching element 13 is likewise actuated.

When a printing plate is being locked-up, the plastic rings 21 with the rubber rings 23 thereon acting as rollers on the tube of the press-on bar 4, serve initially as supporting and guiding rollers for the printing plate as it is introduced into the printing-press. After the rear or trailing edge of the printing plate 3 has reached the locking or clamping position thereof, the pneumatic cylinder 17 is actuated so that the system is swivelled through the intermediary of the preloaded helical spring 18. The plastic rings 21 and the rubber rings 23, acting as roller, thus press the bent-away rear or trailing edge of the printing plate 3 into a clamping slot formed in a clamping device of the plate cylinder 1. After the bent-away rear or trailing edge has been clamped or locked, the pneumatic cylinder 17 is changed or switched over, so that the system returns to the central position thereof as shown in FIG. 1.

Figure 7:
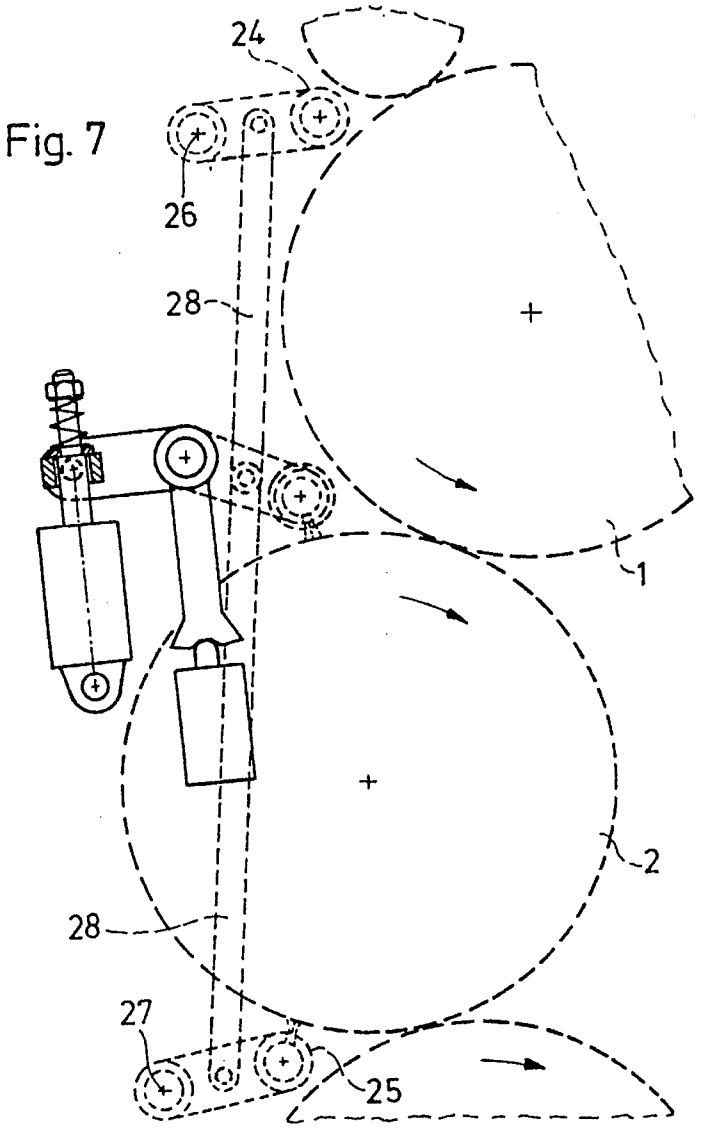
FIG. 7 is another view of FIG. 4 showing another embodiment of the press-on device having additional features.

In FIG. 7, the combination of the aforedescribed press-on safety device with other swivelably disposed protective devices, as shown in broken lines, for example, in front of the nip between the plate cylinder 1 and an inking roller at the top of the figure, and in front of the printing nip between the cylinders 1 and 2. Provided, for example, are protective devices 24 and 25, which are movable likewise about respective swivel axes 26 and 27 which are disposed parallel to the swivel axis 5 of the press-on bar 4. The protective devices 24 and 25 are articulatedly connected by linkages 28 to components of the press-on device.

I claim:

1. In a printing unit of a printing press having a plate cylinder and a blanket cylinder, the combination comprising a press-on bar including a press-on roller applicable against the plate cylinder and swivelable at a spaced distance therefrom about a swivel axis aligned parallel to respective axes of the cylinders, a finger-protection device and a blast air device for blowing air against one of the cylinders, the press-on bar having a longitudinal axis and having a plurality of rollers rotatably mounted thereon, and the blast-air device being formed of a hollow interior of said press-on bar for receiving blast air therein, and nozzle openings in the surface of said press-on bar for discharging blast air from said hollow interior thereof, said longitudinal axis of said press-on bar together with said plurality of rollers rotatable mounted on said press-on bar and said swivel axis being swivelable substantially on a plane passing through a nip between the plate cylinder and the blanket cylinder about said swivel axis in a direction opposite to a direction wherein said press-on roller is applied against the plate cylinder and against a spring-biasing force and being cooperatively engageable with a switching element connected in a circuit of a drive for the printing press.

2. The combination of claim 1, wherein said press-on bar extends from one side of the printing press to the other side thereof and is connected only on the one printing press side to a motorized controlling and swiveling mechanism and on the other printing-press side to an air-supply system, said longitudinal axis of said press-on bar being disposed at an inclination to the axis of the respective cylinder so that said longitudinal axis of said press-on bar is disposed at a greater distance from the cylinder at the printing-press side at which said controlling and swiveling mechanism is located than at the printing-press side at which the air-supply system is connected.

3. The combination according to claim 2, wherein said plurality of rotatable rollers are freely rotatably mounted on said press-on roller axially spaced from one another, and said nozzle opening being directed against the blanket cylinder and being connected via said hollow interior of said press-on roller to the air-supply system.

4. The combination according to claim 2, wherein said controlling and swiveling mechanism comprises a swivel lever fixedly connected to said press-on bar at the one printing-press side, and a pneumatic cylinder fixed to a frame of the printing press, and pneumatic cylinder having a piston rod articulatingly connected through the intermediary of a preloaded spring, to said swivel lever.

5. The combination according to claim 4, including a joint pin mounted on said swivel lever and formed with a through-bore, said system rod extending through said through-bore of said joint pin and through a preloaded helical spring braced between said joint pin and a stop on said piston rod.

6. The combination according to claim 4, wherein said press-on bar is formed of a rigid tube provided with said nozzle openings in the peripheral surface thereof, said plurality of rotatable rollers being freely rotatably mounted on said tube and annually surrounding said tube, said tube, at the ends thereof, being axially offset from respective journal pins swivelably mounted on an identical axis in the frame of the printing press, one of said journal pins being connected to said swivel lever with which said piston rod of said pneumatic cylinders is in engagement.

7. The combination according to claim 6, wherein the other of said journal pins is hollow and is connected to said hollow press-on bar so as to supply air thereto.

8. The combination according to claim 6, wherein said switching element is a limit switch, and including a control cam formed on said swivel lever, said control cam being engageable with said limit switch.

9. The combination according to claim 1, wherein said plurality of rollers are rings of plastic material having a soft-elastic periphery.

10. The combination according to claim 9, wherein said have circumferential grooves formed therein, and rings formed of soft-elastic material are received in said circumferential grooves.

11. The combination according to claim 1, including linkages connecting components of said press-on bar to swivelable finger-protecting devices at other locations of the printing unit.

12. The combination according to claim 11, wherein one of said other locations of the printing unit is in front of a nip between the blanket cylinder and an impression cylinder of the printing unit.

13. The combination according to claim 11, wherein said other locations of the printing unit include in front of a nip between the plate cylinder and an inking roller and in front of the printing nip of the printing unit.

14. The combination according to claim 11, wherein said finger-protecting devices are movable about a swivel axis parallel to said swivel axis of said press-on bar.

* * * * *